US009084446B2

(12) United States Patent
Ramadan

(10) Patent No.: US 9,084,446 B2
(45) Date of Patent: Jul. 21, 2015

(54) HEAD COVERING

(71) Applicant: Faten Ramadan, Northborough, MA (US)

(72) Inventor: Faten Ramadan, Northborough, MA (US)

( * ) Notice: Subject to any disclaimer, the term of this patent is extended or adjusted under 35 U.S.C. 154(b) by 0 days.

(21) Appl. No.: 14/060,124

(22) Filed: Oct. 22, 2013

(65) Prior Publication Data

US 2014/0109293 A1 Apr. 24, 2014

Related U.S. Application Data

(60) Provisional application No. 61/717,754, filed on Oct. 24, 2012.

(51) Int. Cl.
*A41D 23/00* (2006.01)
*A41D 20/00* (2006.01)
*A45D 8/36* (2006.01)

(52) U.S. Cl.
CPC ..... *A41D 23/00* (2013.01); *A41D 20/00* (2013.01); *A45D 8/36* (2013.01)

(58) Field of Classification Search
CPC ..... A41D 23/00
USPC ..... 2/207, 202, 174, 203, 204, 205, 244, 2/279, 918
See application file for complete search history.

(56) References Cited

U.S. PATENT DOCUMENTS

| | | | | | |
|---|---|---|---|---|---|
| D58,944 | S | | 9/1921 | Rosenberg | |
| D115,228 | S | | 6/1939 | Cohn et al. | |
| D134,271 | S | * | 11/1942 | Dobbs | D2/880 |
| 2,574,208 | A | * | 11/1951 | Crowthers | 2/207 |
| 2,735,110 | A | * | 2/1956 | Baker | 2/209.12 |
| 2,859,448 | A | * | 11/1958 | Gaichel | 2/202 |
| 2,988,748 | A | * | 6/1961 | Rollins-Dudley | 2/202 |
| 3,357,027 | A | * | 12/1967 | Feil | 2/209.11 |
| 3,671,977 | A | * | 6/1972 | Degnon | 2/207 |
| 5,621,920 | A | | 4/1997 | Gorsuch et al. | |
| 5,675,841 | A | | 10/1997 | Jackson | |
| D406,687 | S | | 3/1999 | Thorpe | |
| 6,185,749 | B1 | | 2/2001 | Williams | |
| D458,004 | S | * | 6/2002 | Magdziak-Hautala | D2/500 |
| D582,635 | S | * | 12/2008 | Halley-Schamp | D2/881 |
| 7,836,522 | B2 | * | 11/2010 | Blecha | 2/207 |
| 8,516,619 | B2 | * | 8/2013 | Absi et al. | 2/207 |
| 2009/0000011 | A1 | * | 1/2009 | Halley | 2/207 |
| 2009/0126078 | A1 | * | 5/2009 | Rashid | 2/207 |

* cited by examiner

*Primary Examiner* — Anna Kinsaul

(57) ABSTRACT

A unique head covering designed to be comfortable and to enable securing a separate scarf to a person's head is disclosed. The head covering being disclosed makes use of integrated loops and/or clips to enable a person to securely and comfortably attach a separate scarf to the person's head. The head covering consistent with embodiments of the present disclosure may not require the use of pins or knots. Embodiments of the present disclosure further enable the securing of a separate scarf to the head covering in order to cover, for example, a person's neck and chest.

13 Claims, 9 Drawing Sheets

HEAD COVERING

RELATED APPLICATIONS

This application claims the benefit of U.S. Provisional Application No. 61/717,754 filed Oct. 24, 2012, the disclosure of which is incorporated by reference herein.

TECHNICAL FIELD OF DISCLOSURE

The present disclosure relates to a head covering.

BACKGROUND OF THE DISCLOSURE

For a variety of reasons including fashion, religious, custom, and/or convenience some women may use a head covering. Time and effort often must be extended to use pins or tie knots in order to secure a scarf wrapped around the head and/or the neck either as a fashion accessory or in order to conform to religious requirements and/or customs. Some users may wrap a scarf several times around their head and/or neck without pinning the scarf, and this often requires the user to continuously adjust the scarf as it unravels, shifts or moves. Thus there is a need for an improvement for a head covering that overcomes the above listed and other disadvantages.

DESCRIPTION OF THE DRAWINGS

The accompanying drawings, which are incorporated in and constitute a part of this disclosure, illustrate various embodiments of the present disclosure. In the drawings.

DETAILED DESCRIPTION

Figure 1A:
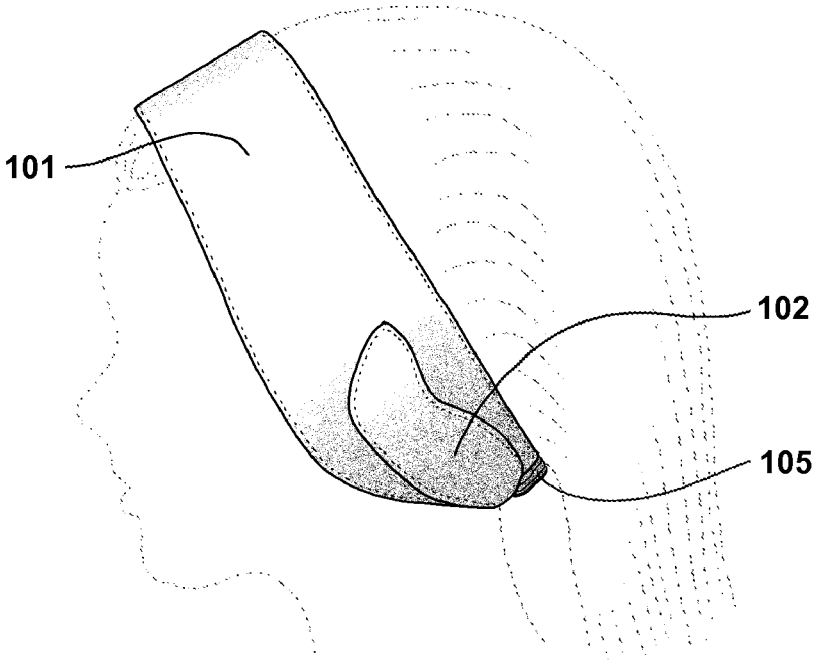
FIG. 1A shows a side view of an embodiment of a head covering comprising a band of material.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods.

Embodiments of the present disclosure may provide a head covering. A head covering consistent with embodiments of the present disclosure may be a unique nondenominational and functional head covering and/or an accessory to head covering options that is worn with or without the use of a scarf. The head covering may comprise a piece of fabric that is carefully crafted and sewn to avoid the creation of pressure points anywhere on the hair, ears, face or neck. The head covering of the present disclosure may also be known as a Hijat.

A head covering consistent with embodiments of the present disclosure may enable the secure attachment of a separate scarf. The scarf may be attached to the head covering so as to, for example, comfortably rest on a person's head and/or around the neck. The head covering consistent with embodiments of the present disclosure may not require the use of pins or knots. For example, a scarf attached to the head covering of the present disclosure may be adjusted to the desired level of comfort with a simple tug or pull.

Figure 1B:
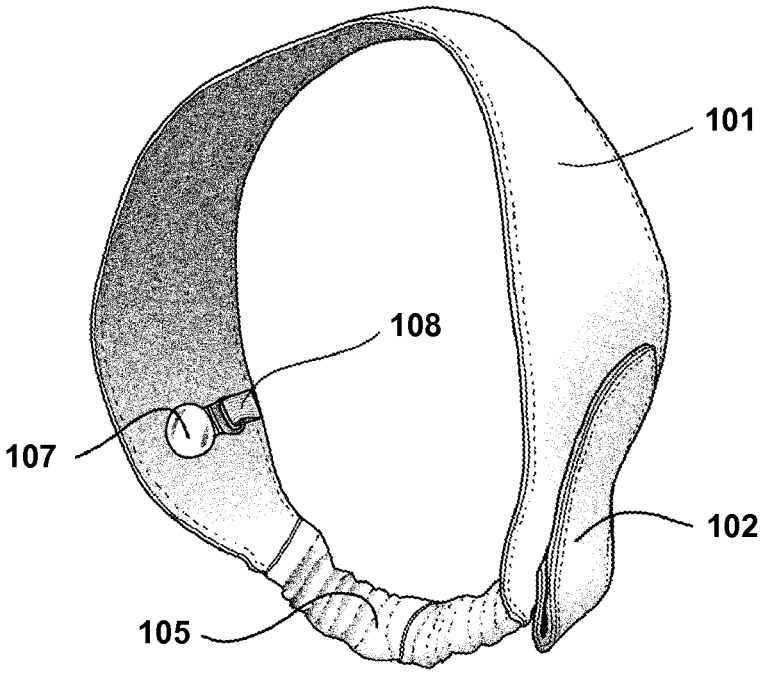
FIG. 1B shows a perspective view of an embodiment of the head covering.

In certain embodiments, a head covering of the present disclosure may not cover the entire head of a person wearing the head covering. For example, the head covering may comprise a headband. FIG. 1A shows a side view of a head covering 101 with an integrated loop 102 and an adjustment means housing 105. FIG. 1A further shows the outside surface of the head covering 101. FIG. 1B shows a perspective view of head covering 101 with a clip 107 affixed to the inside surface of head covering 101 by an attachment means 108. FIG. 1B further shows adjustment means housing 105.

To enable the attachment of a separate scarf without pins or knots, head covering 101 may comprise built-in loops and/or clips such as, for example, integrated loop 102 and clip 107. Embodiments of the disclosure may allow for a plurality of loops 102 and clips 107, and further embodiments of the disclosure may allow the plurality of loops 102 and clips 107 to be placed at different locations of head covering 101.

Referring to FIGS. 1A and 1B, in some embodiments, head covering 101 may be cut on a slight curve at the ears area to provide additional coverage.

In some embodiments, head covering 101 comprise one or more loops 102 sewn or otherwise attached to either the outside or the inside of head covering 101. In other embodiments, loops 102 may not be present on head covering 101. Loops 102 may be constructed from the same fabric as the band or from different fabrics for added contrast. Consistent with embodiments of the disclosure, one or more loops 102 may be positioned in one or more locations.

Figure 2A:
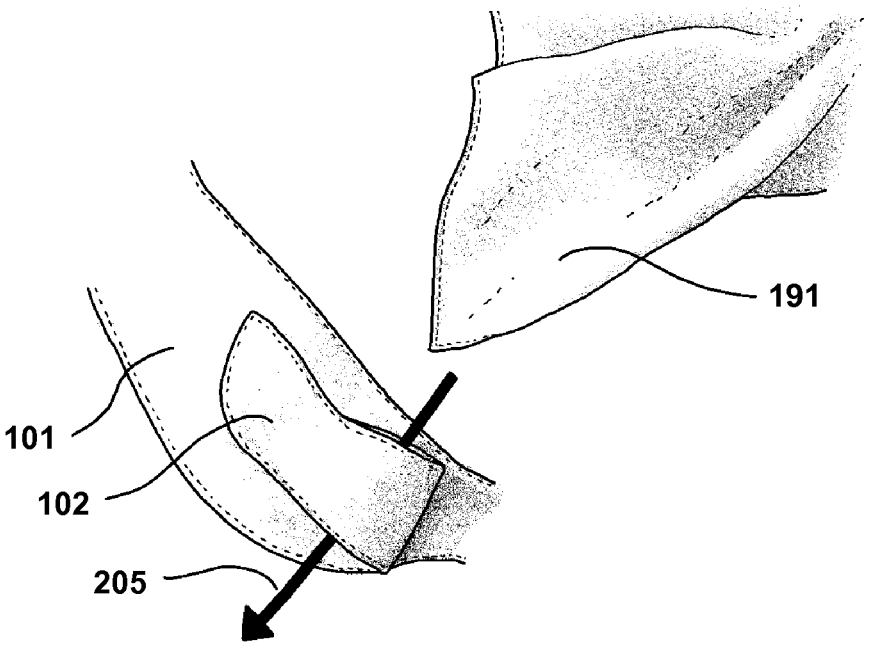
FIGS. 2A and 2B are diagrams illustrating a method for securing a scarf to an embodiment of the head band.
Figure 2B:
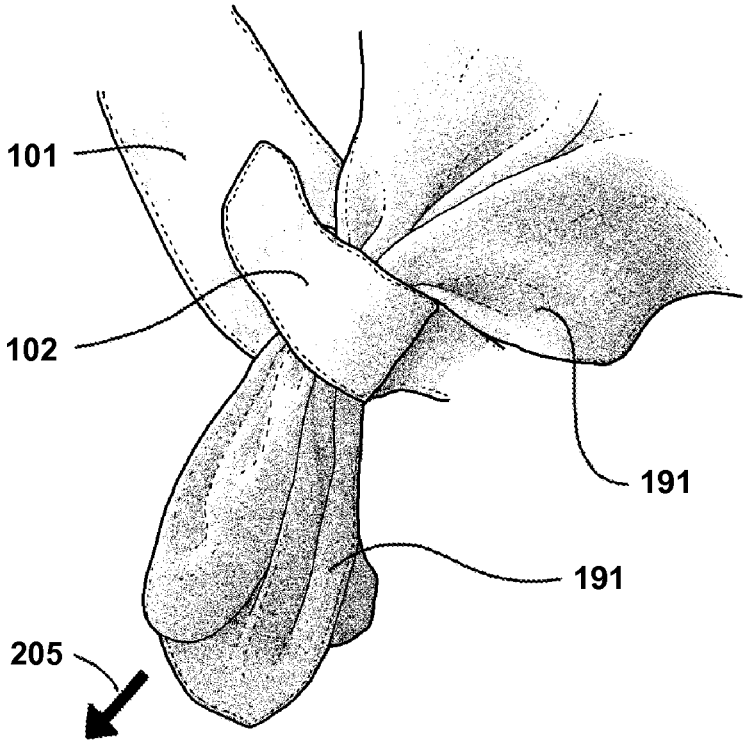

FIGS. 2A and 2B illustrate a method of securing a separate piece of material or scarf 191 to head covering 101. For example, scarf 191 may be pulled through loop 102 upwards, downwards or sideways to attach it to head covering 101 (e.g., as depicted by directional arrow 205). Embodiments including one or more additional loops may further enhance the security of holding scarf 191 or additional scarves.

Figure 10:
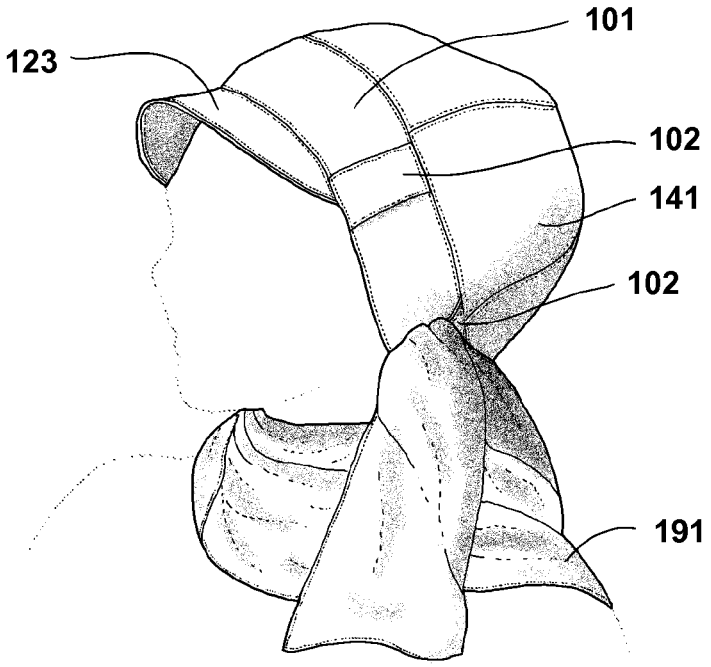
FIG. 10 shows a second embodiment of a scarf secured around a person's head using an embodiment of the head covering.

Embodiments comprising a loop 102 may have the loop 102 attached to head covering 101 in any orientation such as, for example, diagonally (e.g., as shown in FIG. 1A), vertically, or horizontally (e.g., as shown in FIG. 10). Loop 102 has a maximum opening of about 2 inches to about 3 inches. Loop 102 may be attached to head covering 101 or, as will be described below, to any of the Hijat crown designs. Loop 102 may be attached to head covering 101 either by sewing or by any other suitable attachment means including but not limited to: snaps, buttons, hook and loop type material, or zippers. In embodiments having a plurality of loops 102, each loop 102 may allow the attachment of the same or separate scarves 191 of varying fabric types.

Figure 3:
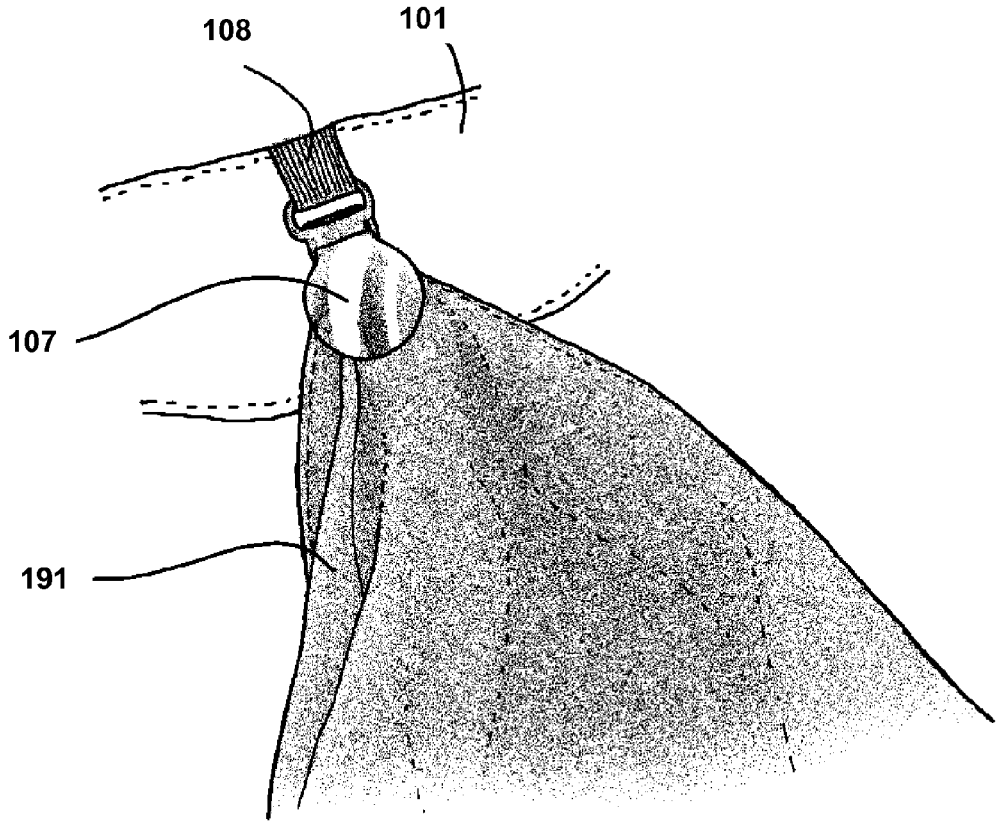
FIG. 3 shows a detailed view of an inside section of an embodiment of the head covering having secured a scarf thereto.

Various embodiments of head covering 101 may comprise one or more built-in clips 107. Some embodiments may not comprise any built-in clips 107. FIG. 3 shows a detailed view of an inside section of head covering 101 where scarf 191 may be secured using the clip 107. The clip 107 is affixed to head covering 101 by an attachment mean 108.

Clip 107 may be comprised of, but not limited to, for example, plastic material, metal or combination of plastic and metal. Clip 107 may be affixed to head covering 101, in any embodiment in several methods. In embodiments comprising one or more clips 107, a person may use one more clips 107 to secure scarf 191 to the person's head and/or enable the optional additional covering of their neck as in FIGS. 10, 11A and 11B. Embodiments including one or more additional clips may further enhance the security of scarf 191 to the person's head and/or around their neck.

Figure 4A:
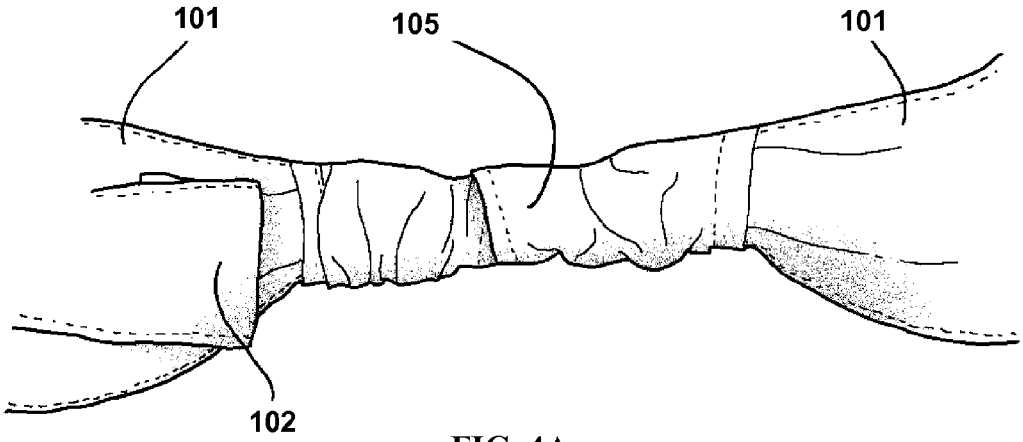
FIG. 4A shows a section of an embodiment of an adjustment means housing of the head covering.
Figure 4B:
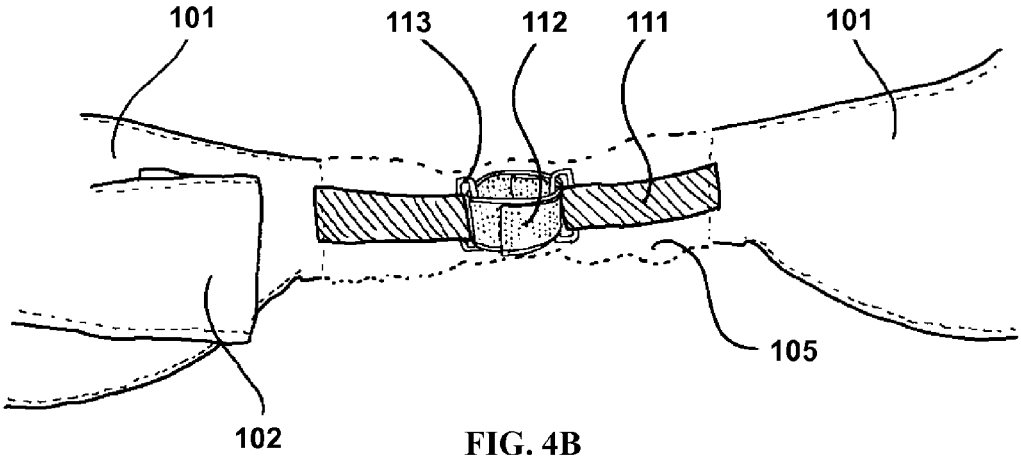
FIG. 4B shows an embodiment of an adjustment means residing inside the adjustment means housing.

FIG. 4A shows a section of head covering 101 where an adjustment means housing 105 is integrated to head covering 101. FIG. 4B shows the inner details of adjustment means housing 105, the housing 105 is shown in phantom by the broken lines.

Referring to FIGS. 4A and 4B, embodiments of head covering 101 may comprise, for example, but not be limited to, adjustment devices 111, 112 and 113 individually or in combination. Adjustment devices 111, 112, and 113 individually or in combination, may ensure best fit and comfort for a user's head. As shown, in FIG. 4B, adjustment device 111 may comprise an elastic type material while adjustment devices 112 and 113 may be comprised of non-elastic materials. Though FIGS. 4A and 4B show one embodiment of adjustment devices 112 and 113, other embodiments may comprise, but not limited to: a strip of hook and loop type material (shown in FIG. 4B, 112) around two rings (shown in FIG. 4B, 113); two strips of hook and loop type material; at least one ribbon of material on two sides of an opening that can be brought together with a clasp; at least one ribbon of material with multiple loops that can be adjusted by having a type of open hook catch one of the loops; at least one ribbon of material with a series of holes where a belt type buckle can be used to select a particular hole to adjust the size.

Head covering 101 may come in different embodiments, including but not limited to any one or combination of the following: a first embodiment comprising a single built-in loop either on the left, right side or center back of head covering 101 and no built-in clip; a second embodiment comprising a single built-in loop on either the left or right side of head covering 101 and one built-in hidden clip on the opposite side; a third embodiment comprising a single built-in loop on either the left or right side of head covering 101 and two built-in hidden clips on each side; a fourth embodiment comprising three built-in hidden clips: one on each side of the band and one in the center back of head covering 101 crown; and a fifth embodiment comprising built-in loop either on the left or right side of the Hijat band, one or more clips and a loop at the center of head covering 101 crown.

Figure 5A:
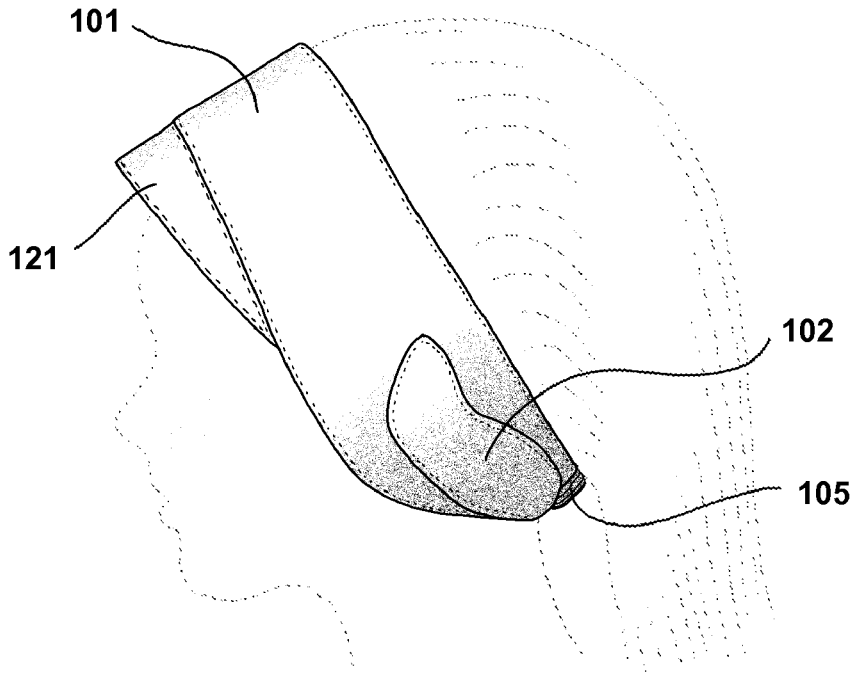
FIG. 5A shows a side view of an embodiment of the head covering having a first optional brim.
Figure 5B:
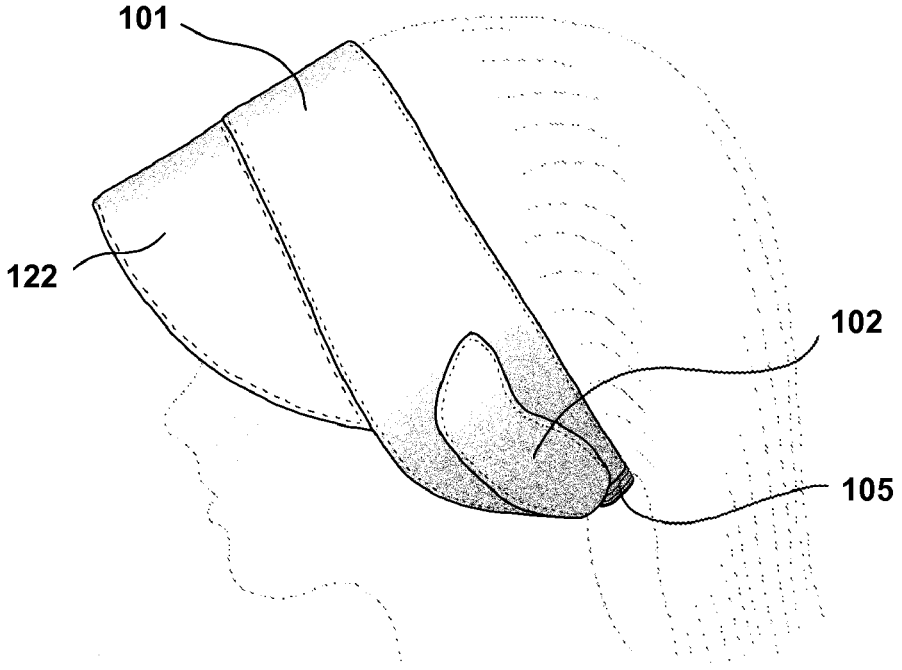
FIG. 5B shows a side view of an embodiment of the head covering having a second optional brim.

FIG. 5A shows side view of head covering 101 comprising integrated loop 102, an adjustment means housing 105 and a first optional brim 121. FIG. 5B shows side view of band 101 comprising integrated loop 102, an adjustment means housing 105 and a second optional brim 122.

Consistent with embodiments of the disclosure, head covering 101 may comprise a brim attached to head covering 101. Other embodiments of head covering 101 may not comprise the brim. Referring to FIGS. 5A, 5B and 10, brim 121, 122 and 123 may take different shapes and designs. A brim consistent with embodiments of the present disclosure may be made of the same fabric as head covering 101 or from different fabrics for added comfort and/or contrast.

In some embodiments, head covering 101, brim 121, 122 or 123, and loops 102 may be backed with different materials to maintain form and increase durability.

Figure 6A:
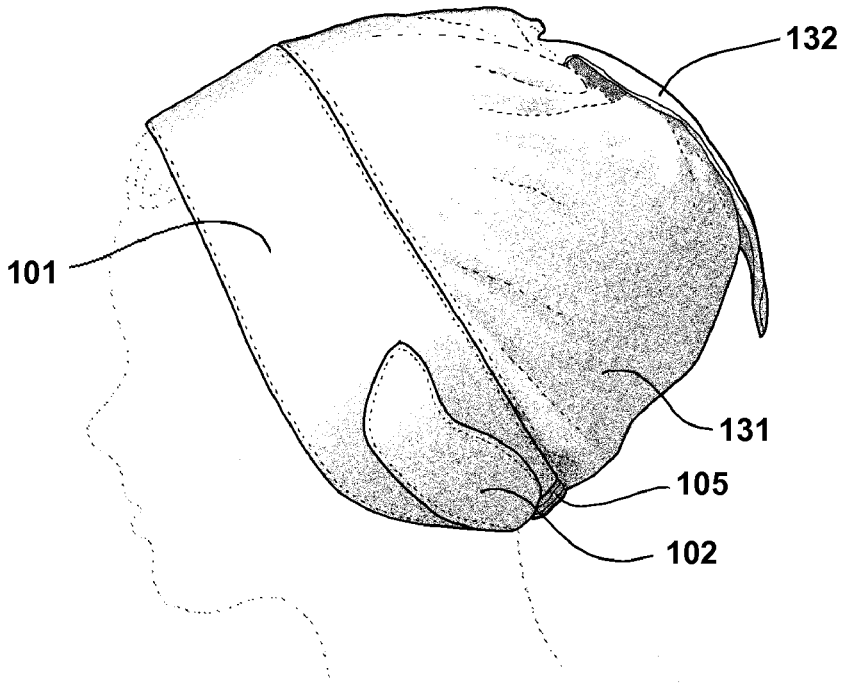
FIG. 6A shows a side view of an embodiment of the head covering having an open crown.
Figure 6B:
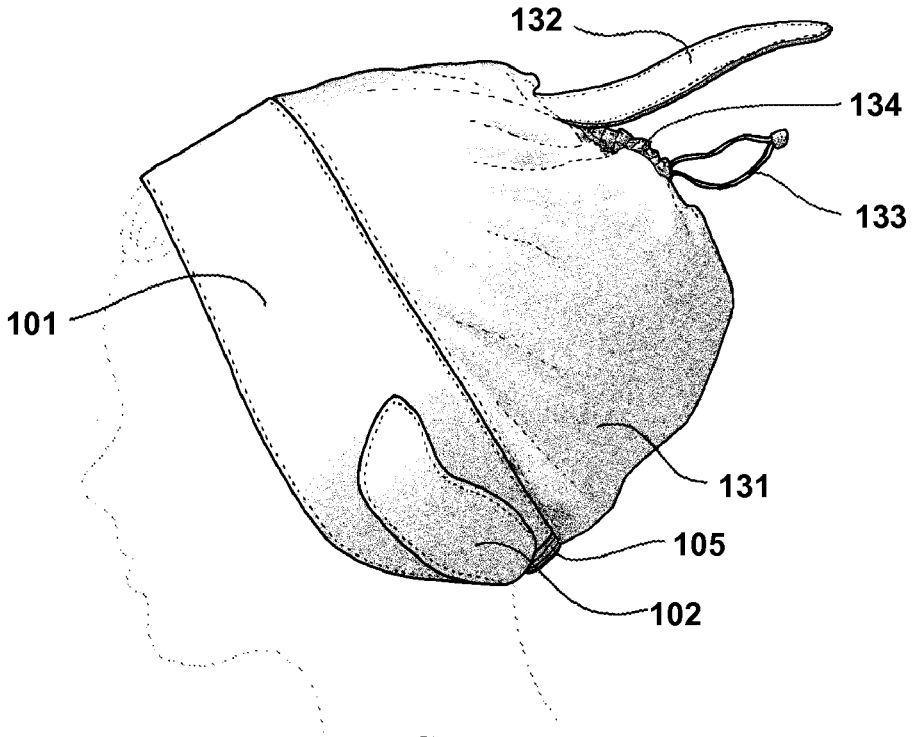
FIG. 6B shows another side view of an embodiment of the head covering having an open crown.

FIG. 6A shows a side view of head covering 101 having an open crown 131. An integrated flap 132 may be attached to crown at the top of the opening. FIG. 6A further shows integrated loop 102 and adjustment means housing 105. FIG. 6B shows head covering 101 having open crown 131 with integrated flap 132 lifted revealing a drawstring (or draw cord) 133 at crown opening 134.

Figure 7:
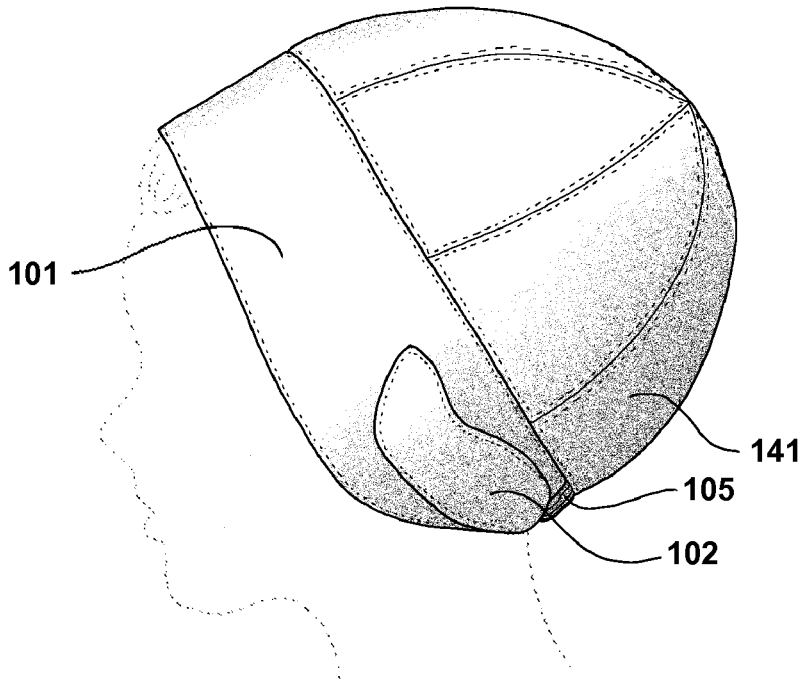
FIG. 7 shows a side view of the head covering having a closed crown.

FIG. 7 shows a side view of head covering 101 having a closed crown 141. As shown in FIG. 7, embodiments of head covering 101 having closed crown 141 may also comprise integrated loop 102. A portion of adjustment means housing 105 can also be seen in FIG. 7.

Figure 8:
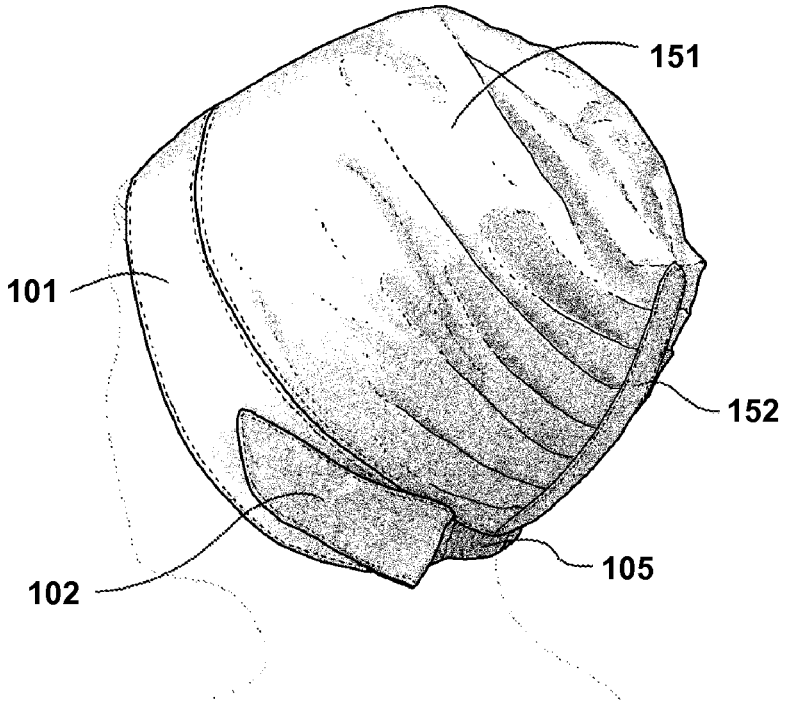
FIG. 8 shows a perspective view of the head covering having a closed crown.

FIG. 8 shows a perspective view of head covering 101 having a closed crown 151 with pleats emerging from the center back portion of head covering 101. Attached to closed crown 151 may be a strip of material 152 where the pleats may originate. Closed crown 151 may be attached to head covering 101. As shown in FIG. 8, embodiments of head covering 101 having closed crown 151 may comprise integrated loop 102 and an adjustments means housing 105.

Referring to FIGS. 6A, 7 and 8, crowns 131, 141 or 151 may be made of the same fabric as head covering 101 or from a different fabric for added comfort and/or contrast. Consistent with embodiments of the present disclosure, the head covering may comprise a full crown or a partial crown. The partial crown may not cover or hold the entire hair. In some embodiments, the partial crown may comprise a built-in string, while other embodiments may not comprise the built-in string. A user's hair may be exposed to fall down on the shoulders or may be tied into a bun. Crowns 131, 141 and 151 may take different shapes and designs.

Referring to FIGS. 6A and 6B, embodiments of head covering 101 may comprise an open crown 131. In some embodiments, open crown 131 may comprise an opening 134. For example, open crown 131 may be opened and closed using draw cord 133.

In some embodiments, a flap 132 may be attached to cover any remaining opening in open crown 131. Flap 132 may be closed over the opening 134 using any one of closing devices including but not limited to: zippers, snaps, buttons, drawstrings or draw cords, strips hook and loop type material, or any other suitable closing devices. In other embodiments, flap 132 may simply lay over opening 13 and may generally be held in place by gravity.

FIG. 7 shows another embodiment of head covering 101. For example, some embodiments of the head covering may not comprise an opening in the crown portion of head covering 101. In these embodiments, head covering 101 may comprise a closed crown 141.

FIG. 8 shows another embodiment of head covering 101. As mentioned above, some embodiments of the head covering may not comprise an opening in the crown portion of the head covering. In these embodiments, head covering 101 may comprise a crown 151. Moreover, some embodiments of head covering 101 may comprise pleats generally on the back side of head covering 101. In some embodiments, head covering 101 may further comprise a strip of material 152 where the pleats come together at the center back.

Almost any fabric type may be used to construct head covering 101. Lightweight, medium or heavyweight fabrics may be used for either head covering 101 and, in some embodiments, the crown. A non-limiting list of fabrics includes, but is not limited to, twill cotton, pima cotton, broadcloth cotton, denim, cotton corduroy, linen, silks shantung, silk organza, silk satin, silk dupioni, blend of linen and cotton, blend of rayon and Linen, blend of rayon and silk, blend of cotton and silk, blend of linen and silk, wool gabardine or blend of wool and silk.

Figure 9:
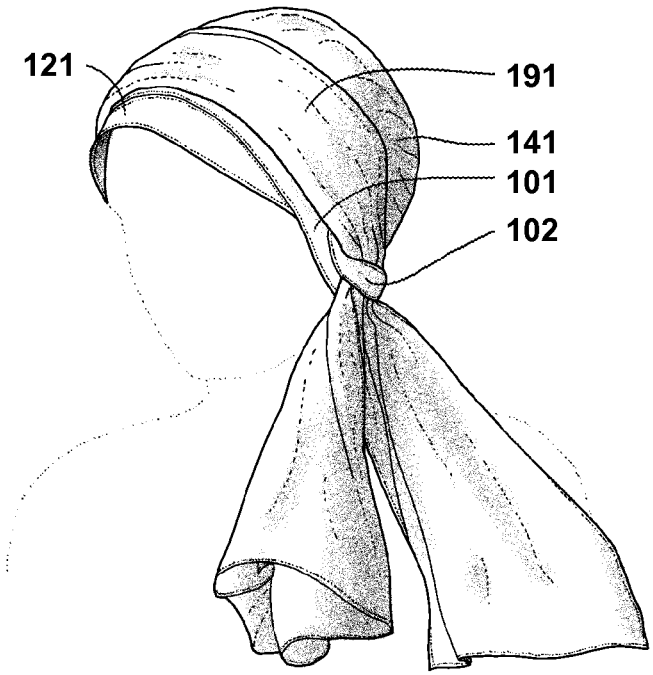
FIG. 9 shows a first embodiment of a scarf secured around a person's head using an embodiment of the head covering.

FIG. 9 shows scarf 191 secured around a person's head using head covering 101 consistent with embodiments of the present disclosure. In FIG. 9, both ends of scarf 191 have been threaded through the loop 102. Moreover, FIG. 9 shows a brim 121 attached to head covering 101 in this embodiment. Though FIG. 9 shows head covering 101 with crown 141, crown 151 may also be used.

FIG. 10 shows a head covering comprising a third brim 123 and two loops 102 placed horizontally on head covering 101. Scarf 191 may be securely attached to a person's head while covering their neck by threading that scarf ends through the bottom horizontal loop 102 (not easily visible in this view).

Figure 11A:
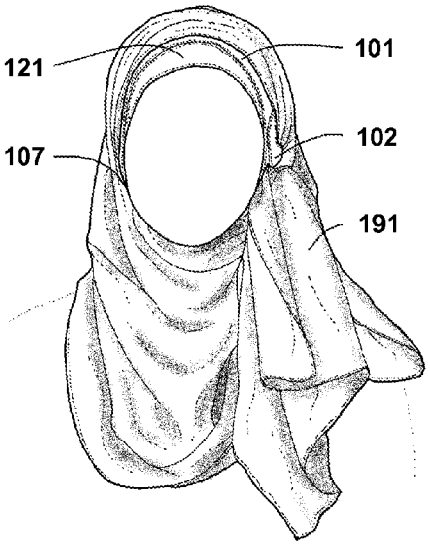
FIG. 11A shows a front view of a third embodiment of a scarf secured around a person's head using an embodiment of the head covering.
Figure 11B:
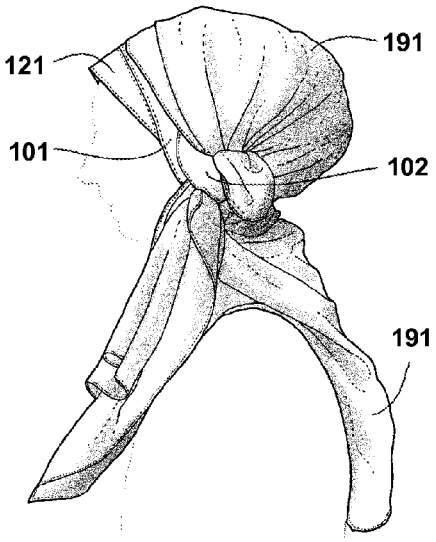
FIG. 11B shows a side view of a fourth embodiment of a scarf secured around a person's head using an embodiment of the head covering.

FIGS. 11A and 11B show front and side views of scarf 191 secured to a person's head using head covering 101. For example, scarf 191 may be secured on the person's head using the integrated loop 102 and is secured around the neck using clip 107 affixed to the inside of head covering 101.

Head covering 101 may enable the secure attachment of separate scarves in multiple configurations. For example, a separate scarf 191 may be secured to a person's head by threading one or both ends of the scarf 191 through loop 102. In some embodiments, scarf 191 may be folded then wrapped around the person's head as shown in FIG. 9. In other embodiments, scarf 191 may remain unfolded to cover the crown as shown in FIGS. 11A and 11B. In these embodiments, both ends of scarf 191 may be pulled through the loop 102. Moreover, in some embodiments, one or both ends of scarf 191 may be held by clip 107. In this way, scarf 191 may cover the person's neck or to achieve a different look and style as shown in FIGS. 9, 10, 11A and 11B.

A head covering consistent with embodiments of the present disclosure has many advantages. When using the disclosed head covering, the scarf may stay secured to the person's head and there may be no need for constant adjustments. The design of the head covering may be such that there are no pressure points anywhere on the head or the neck. The head covering may enable the movements of the head in any direction without slipping off. The head covering may hold a user's hair and may shape the head profile without the use of any other objects. There may be no need to tie or pin the user's hair. The head covering may allow the application of a separate scarf in very simple steps to create a new look never before possible. There are multiple ways of applying a separate scarf to the head covering to create individual styles, and although the present disclosure anticipates those styles, only some of those were mentioned in this disclosure.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of this document and associated figures.

What I claim is:

1. A head covering comprising:

a headband, the headband comprising a band of material enabled to encircle a person's head, the band having an outside surface and an inside surface opposite the outside surface;

the band further comprising two curved portions, each curved portion positioned on the band to correspond to and to provide at least partial coverage of a person's ear when the head covering is worn;

at least one clip attached to the inside surface of the band;

at least one fabric loop with an opening of about 2 to 3 inches attached to the outside surface of the band, at least one piece of material separate from the band of material of the headband; wherein the at least one clip and the at least one fabric loop selectively attach the at least one piece of material to the headband; and an adjustment means comprising a housing integrated with said band, said adjustment means being configured to cause an alteration to a length of said band; wherein said adjustment means further comprises at least one non-elastic element configured to enable an adjustment of said length of said band, said non-elastic element comprising at least one member of a group consisting of: at least one strip of hook and loop type material, at least one ribbon of material on two sides of an opening that is brought together with a clasp, at least one ribbon of material with multiple loops wherein a size of said at least one ribbon with multiple loops is adjusted by having a specific type of open hook catch one of said loops, and at least one ribbon of material with a series of holes wherein a belt type buckle is used to select a particular hole to adjust a size of said at least one ribbon of material with a series of holes.

2. The head covering as in claim 1, wherein said adjustment means further comprises at least one elastic means configured to enable adjustment of said length of said band.

3. The head covering as in claim 1, further comprising a brim attached to an edge of said band, said brim extending outwardly from said edge of said band.

4. A head covering comprising:

a headband, the headband comprising a band of material enabled to encircle a person's head, the band having an outside surface and an inside surface opposite the outside surface;

the band further comprising two curved portions, each curved portion positioned on the band to correspond to and to provide at least partial coverage of a person's ear when the head covering is worn;

at least one clip attached to the inside surface of the band;

at least one fabric loop with an opening of about 2 to 3 inches attached to the outside surface of the band, at least one piece of material separate from the band of material of the headband; wherein the at least one clip and the at least one fabric loop selectively attach the at least one piece of material to the headband;

an adjustment means comprising a housing integrated with said band, said adjustment means being configured to cause an alteration to a length of said band; wherein said adjustment means further comprises at least one non-elastic element configured to enable an adjustment of said length of said band, said non-elastic element comprising at least one member of a group consisting of: at least one strip of hook and loop type material, at least one ribbon of material on two sides of an opening that is brought together with a clasp, at least one ribbon of material with multiple loops wherein a size of said at least one ribbon with multiple loops is adjusted by having a specific type of open hook catch one of said multiple loops, and at least one ribbon of material with a series of holes wherein a belt type buckle is used to select a particular hole to adjust a size of said at least one ribbon of material with a series of holes; and a crown attached to said band.

5. The head covering as in claim 4, wherein said adjustment means further comprises at least one elastic element configured to enable adjustment of said length of said band.

6. The head covering as in claim 4, further comprising a brim attached to an edge of said band, said brim extending outwardly from said edge of said band.

7. The head covering as in claim 4, wherein said crown comprises an opening at approximately a top portion of said crown.

8. The head covering as in claim 7, wherein said opening of said crown is closable with at least one member of a group of closing devices consisting of:

at least one drawstring, at least one zipper, at least one snap, at least one button, and at least one strip of hook and loop type material.

9. The head covering as in claim 7, further comprising a flap attached to said crown to cover the opening of said crown.

10. A method of creating a head covering, the method comprising the steps of:

providing a headband comprising a band of material enabled to encircle a person's head, the band further comprising two curved portions to provide at least partial coverage of a person's ear when the head covering is worn;

providing at least one piece of material separate from the band of material of the headband;

affixing at least one clip to an inside surface of said band;

sewing at least one fabric loop to an outer surface of said band, the at least one fabric loop having an opening of about 2 to 3 inches;

threading the at least one piece of material through said at least one fabric loop;

securing at least an edge of said at least one piece of material to said band; and integrating at least one adjustment means comprising a housing in at least a portion of said band, said adjustment means further comprising a non-elastic element configured to cause an adjustment of a length of said band and wherein said non-elastic element comprises at least one member of a group consisting of: at least one strip of hook and loop type material, at least one ribbon of material on two sides of an opening that is brought together with a clasp, at least one ribbon of material with multiple loops wherein a size of said at least one ribbon with multiple loops is adjusted by having a specific type of open hook catch one of said multiple loops, and at least one ribbon of material with a series of holes wherein a belt type buckle is used to select a particular hole to adjust a size of said at least one ribbon of material with a series of holes.

11. The method of claim 10, wherein integrating said at least one adjustment means in at least said portion of said band further comprises integrating an elastic element.

12. The method of claim 10, further comprising:

attaching an open crown to said band;

integrating at least one closing device to said open crown to enable a closing of said open crown; and attaching at least one of the following: at least one additional loop or at least one additional clip to said open crown to secure said at least one piece of material.

13. The method of claim 10, further comprising:

attaching a closed crown to said band; and attaching at least one of the following: at least one additional loop or at least one additional clip to the said closed crown to secure said at least one piece of material.

* * * * *